US005248035A

United States Patent [19]

Gallagher

[11] Patent Number: 5,248,035

[45] Date of Patent: Sep. 28, 1993

[54] COLLECTION AND STORAGE UNIT FOR RECYCLABLE CONTAINERS

[76] Inventor: Patrick Gallagher, 1467 Midland Ave. 5H, Yonkers, N.Y. 10708

[21] Appl. No.: 856,873

[22] Filed: Mar. 24, 1992

Related U.S. Application Data

[63] Continuation of Ser. No. 578,160, Sep. 6, 1990, abandoned.

[51] Int. Cl.[5] ..... B65D 1/24; B65D 21/02; B65D 71/00

[52] U.S. Cl. ..... 206/427; 206/428; 206/511; 220/4.22; 220/509; 220/518; 220/519; 220/771

[58] Field of Search ..... 220/94 A, 94 R, 512, 220/513, 514, 515, 516, 517, 518, 519, 507, 509, 422, 423, 424, DIG. 15, 421, 510; 206/509, 511, 427, 428, 430, 443, 446, 139, 203

[56] References Cited

U.S. PATENT DOCUMENTS

| | | | |
|---|---|---|---|
| D. 150,031 | 6/1948 | Richards | 220/516 X |
| 3,141,599 | 7/1964 | Hasselhoff | 229/117.22 X |
| 3,246,790 | 4/1966 | Martin | 220/517 |
| 3,269,586 | 8/1966 | Quimby et al. | 220/9.4 R |
| 3,272,378 | 9/1966 | Weber | 220/510 |
| 3,282,461 | 11/1966 | Beesley et al. | 220/513 X |
| 3,386,607 | 6/1968 | Keene | 220/520 X |
| 3,407,961 | 10/1968 | Box | 220/4.24 X |
| 3,481,502 | 12/1969 | Slayman | 206/511 X |
| 3,616,943 | 11/1971 | Brink | 206/511 X |
| 3,707,227 | 12/1972 | Britt | 206/443 |
| 3,710,761 | 1/1973 | Gregory | 220/4.24 X |
| 3,961,708 | 6/1978 | von Dohlen et al. | 220/4.21 X |
| 4,175,691 | 11/1979 | Cornell et al. | 206/509 |
| 4,319,685 | 3/1982 | David | 206/427 X |
| 4,499,997 | 2/1985 | Swingley, Jr. | 206/427 X |
| 4,760,921 | 8/1988 | Licari | 206/509 x |
| 4,789,062 | 12/1988 | Walsh | 206/427 |
| 4,899,874 | 2/1990 | Apps et al. | 206/427 X |
| 4,928,841 | 5/1990 | Arthurs | 206/427 X |

FOREIGN PATENT DOCUMENTS

| | | | |
|---|---|---|---|
| 695171 | 9/1964 | Canada | 220/516 |

*Primary Examiner*—Steven N. Meyers
*Assistant Examiner*—Jacob K. Ackun, Jr.
*Attorney, Agent, or Firm*—Nolte, Nolte and Hunter

[57] ABSTRACT

A carrier moldable from plastic, aluminum, paper mache and the like for collecting and transporting empty containers such as soda bottles or cans.

12 Claims, 6 Drawing Sheets

COLLECTION AND STORAGE UNIT FOR RECYCLABLE CONTAINERS

This is a continuation of application Ser. No. 07/578,160 filed Sep. 6, 1990, now abandoned.

The present invention relates to carriers or cases for holding and transporting beverage containers and, more particularly, recyclable beverage containers and the like.

BACKGROUND OF THE INVENTION

Conservation and environmental practices, many of them augmented by laws, have occasioned widespread orderly collection of empty containers as, for example, soda and beer containers (cans or bottles). Collections are stimulated by container deposits established by law. Numerous organizations, such as the Boy Scouts, Girl Scouts, church and civic-minded organizations, engage in collecting such containers and delivering them to recycling or disposal centers.

The manufacturers of such beverage products ship or distribute their filled containers in groups of varying sizes, some of which are designated "six packs", "eight packs" or "twelve packs". Many are shipped in carriers of two dozen or more containers. Cartons or cases for such groupings are made of various substances such as wood, metal, plastic or cardboard. Some of these are destroyed by the simple act of removing the individual containers. Other, more sturdy carriers (because of their weight and/or various size groupings) are cumbersome or lack uniformity for collecting and temporarily stacking, warehousing and shipping empties. Some carriers are returned to the shipper by the retailer for re-use.

Carriers generally of the type above described may be found in such patents as Read U.S. Pat. No. 2,574,983, Hammett U.S. Pat. No. 4,789,063, Geiler U.S. Pat. No. 4,782,945 and Abraham U.S. Pat. No. 4,887,716. Some as, for example Read, are made of very durable material and are too expensive for widespread collection purposes. Others such as a typical six pack or eight pack group or array, held together by a flexible plastic holder termed a "top grip" (see 54 of Hammett, supra, column 9, line 1) are damaged upon removal of product from the group. It is accordingly an object of my invention to make a relatively inexpensive carrier which itself is readily nested with other carriers for storage or shipment to groups collecting empty beverage containers. It is an object of my invention to provide such a carrier that can contain a predetermined uniform number of containers in manageable groups adapted to stacking, counting and shipment.

It is a further object of my invention to provide a carrier made, preferably of plastic or other light moldable material, and formed as a unitary bottom and top matingly securable to each other to form a closed carrier.

Another object of the invention is to provide relatively inexpensive compartmented carriers which may be uniformly stacked and secured to each other.

Still another object is to provide a plastic carrier made of recycled material with or without a biodegradable addition to promote recycling and allow disposal without environmental detriment.

SUMMARY OF THE INVENTION

Briefly stated, the present invention is preferably a unitary molded product forming a case having a bottom section and a top section. One or both sections comprise upstanding columns which, when juxtaposed, define compartments for receiving beverage containers. The top is connected to the bottom by, inter alia, a live hinge and mating juxtaposed studs and openings plus overlapping lips to provide stability and integrity. The carrier so formed has additional mating or alternatively mating spines or spicules to engage with other similar carriers in stacked orientation. A simplified integral handle is provided on each carrier.

DESCRIPTION OF THE DRAWINGS

Referring to FIGS. 2 and 3, a moldable sheet 10, which may be formed of plastic, aluminum or other moldable material, is molded in accordance with the invention. Vacuum injection or pressure molding may be employed depending on the selection of material, as is well known to one skilled in the molding art. Sheet 10 is formed into a top portion 12 and a bottom portion 14. The top portion is molded to form a top 16 upstanding side walls 18, 19, 20 and 22. Hollow posts or abutments 24 are formed in regular columns and rows integral with top 16. Posts 24 (52) are regularly arranged at the intersections of straight line Cartesian coordinate axes and form blunted corners of imaginary squares as clearly illustrated in FIG. 2. A lip 26 formed at the top of walls 18, 20 and 22 has upstanding lugs 28 and a peripheral channel 30. The upstanding walls have arcuate scalloped portions 32 to adapt to the contour of containers (not shown) and are spaced by intervening wall spaces 34. In similar fashion, the bottom portion or section 14 has a bottom 36, upstanding side walls 38, 39, 40 and 42, formed with arcuate cylindrical concavities 44 and intervening flat sections 46. Lip 48 formed at the top of the walls 38, 40 and 42 has complementary female openings 50 to receive male lugs 28 of top section 12. The bottom 36 has integrally formed upstanding columns or abutments of hollow posts 52 arranged in columns and rows whose centers are spaced to conform with the centers of the posts 24 of the top 16. The thickness of the sheet 10 is reduced to form a live hinge 54 permitting the top 12 to be closed on top of the bottom 14.

Figure 1:
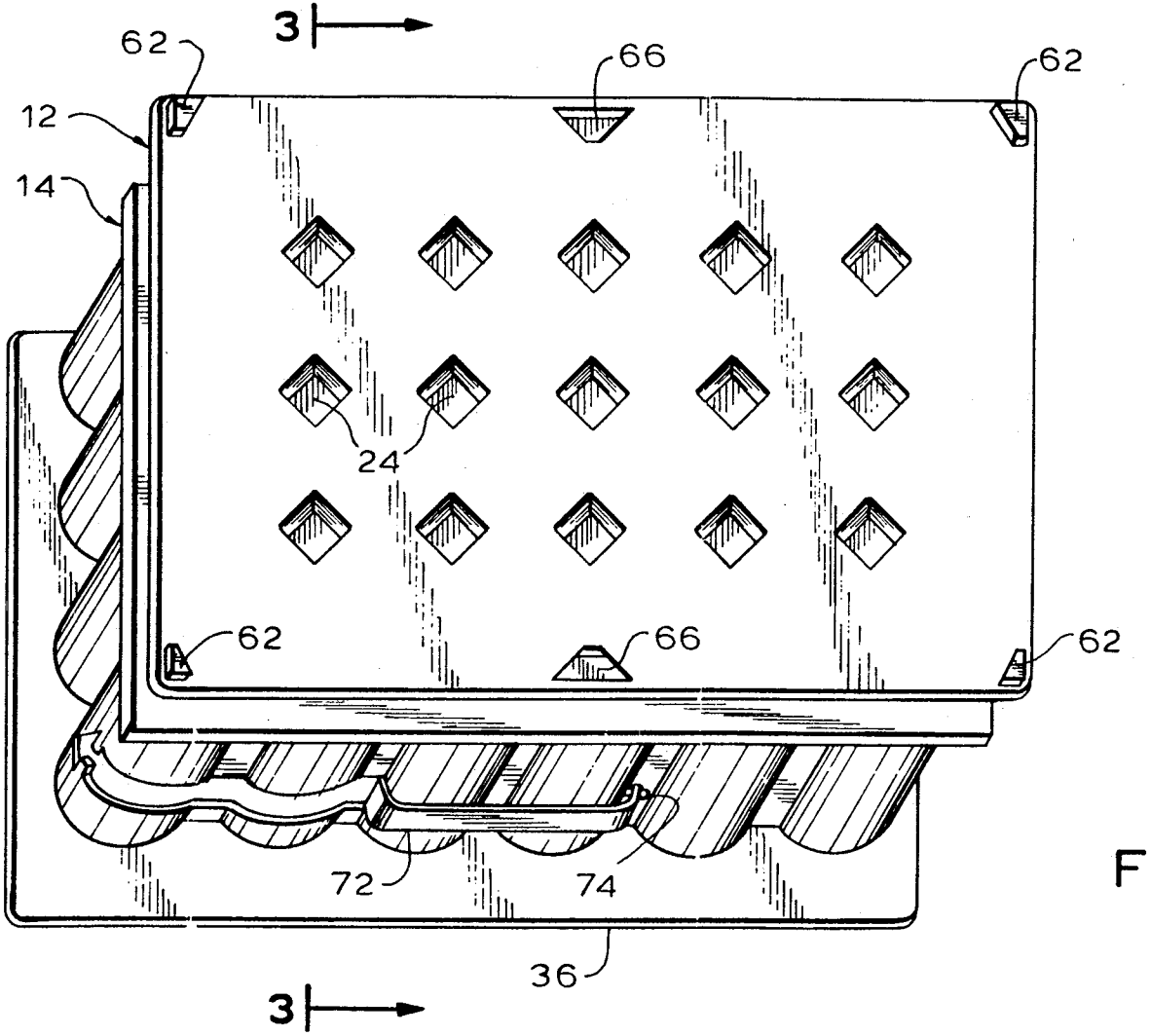
FIG. 1 is an isometric view of a carrier constructed in accordance with my invention.

In this conformation, the arcuate portions 32 and 44 are in alignment and with the aligned posts and columns 24, 52 form more or less cylindrical compartments to receive containers (not shown). The channel 30 is pressed over the edge 49 of the lip 48 to secure the top 12 to the bottom 14. At the same time, the lugs 28 enter the openings 50 to provide additional rigidity to the structure.

The side walls 18, 20, and 22 and the top 16 may be extended out at 21 to form an extended overhang 23 to the top portion 12. In like fashion, an extension 34 may be formed in bottom section 14. These structures are not essential but add stability to the carrier and can have mating structures 62 (FIG. 1) for stacking.

Figure 4:
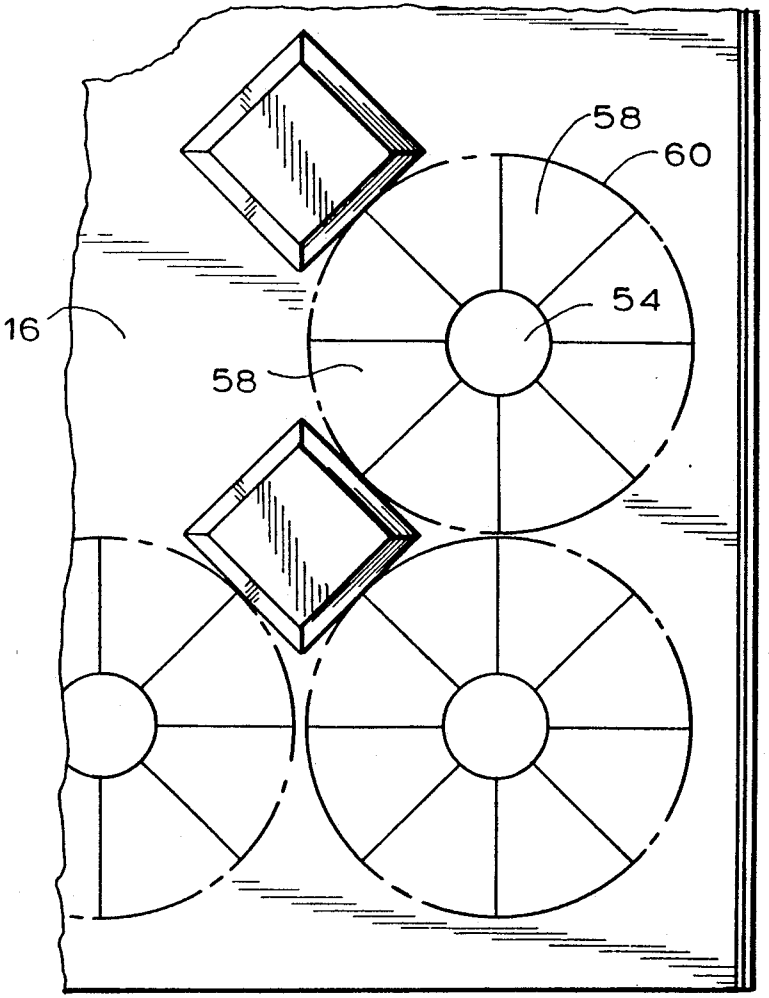
FIG. 4 is a fragmentary plan view inside a portion of the top of the carrier modified to permit loading after closure.

Referring now to FIG. 4, the top 16 can have punchouts 55 into container compartments defined by the posts 24, 52. Radial cuts 55 and punchout 54 form flaps 58. A reduction of the thickness or scoring of the sheet 10 along the circumferential line 60 shown in dash-dot produces live hinges. This embodiment permits assembling and closing the carrier prior to loading containers through the flaps 58. The carrier may then be used as a collecting carrier and containers added to it one by one without the need of opening the top section 12 from the bottom section 14.

Figure 5:
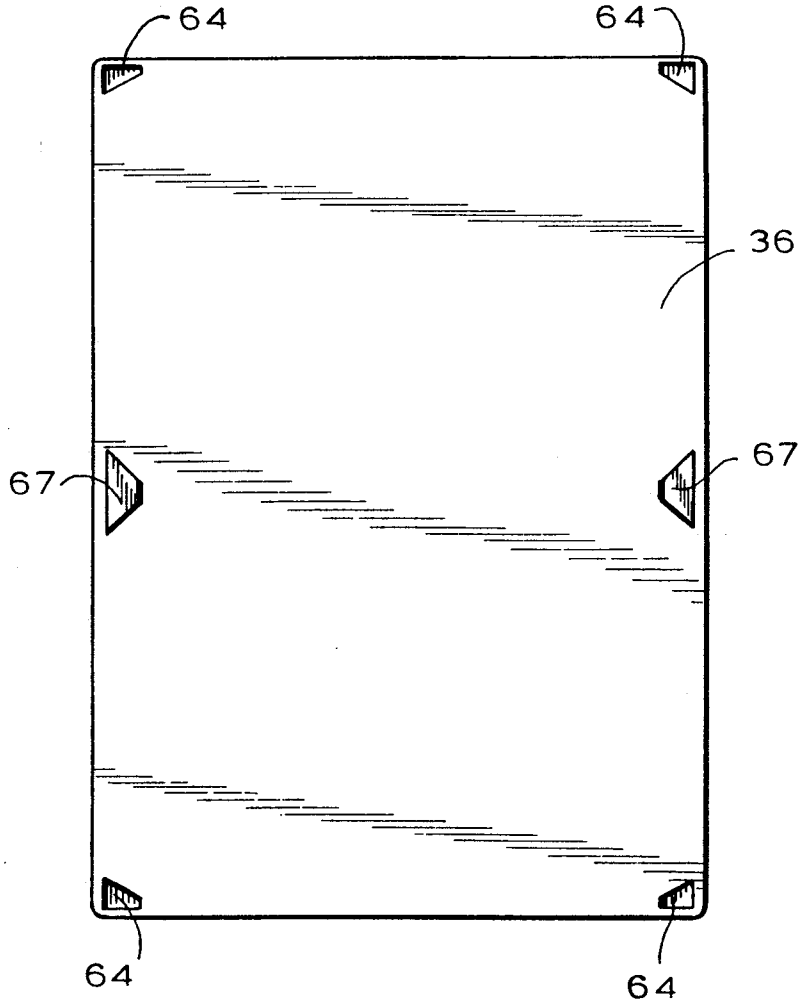
FIG. 5 is a view taken on line 5—5 of FIG. 3.

Referring now to FIG. 1, the .bottom corners show the shaped male lugs 62, in the corners of the top. Intermediate these two lugs is the female opening 66. On the underside (FIG. 5) of the bottom 36 are corresponding mating female openings 64 and mating male lugs 67. These mating lugs secure the carriers to each other in vertical stacking.

Figure 2:
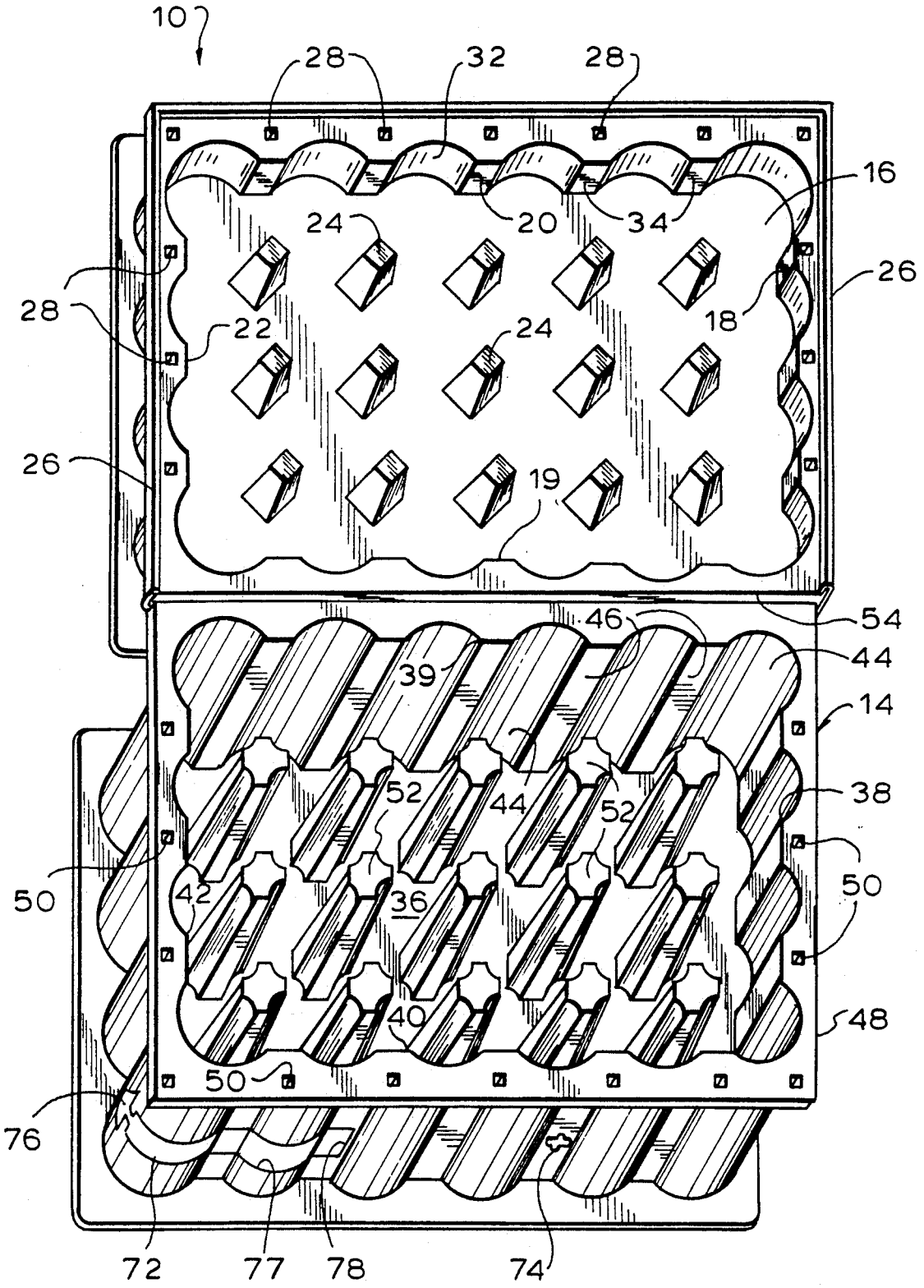
FIG. 2 is an axonometric view of a moldable sheet molded in accordance with of my invention.
Figure 3:
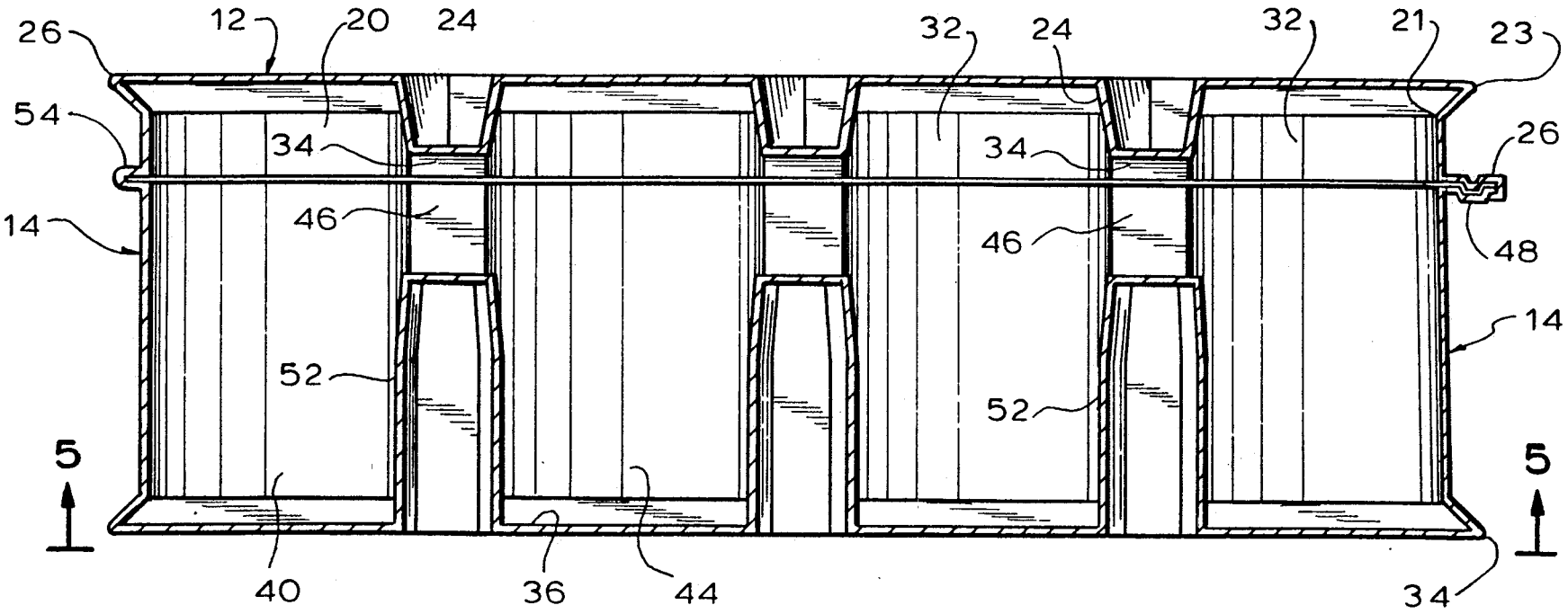
FIG. 3 is a sectional elevation taken on line 3—3 of FIG. 1.
Figure 3A:
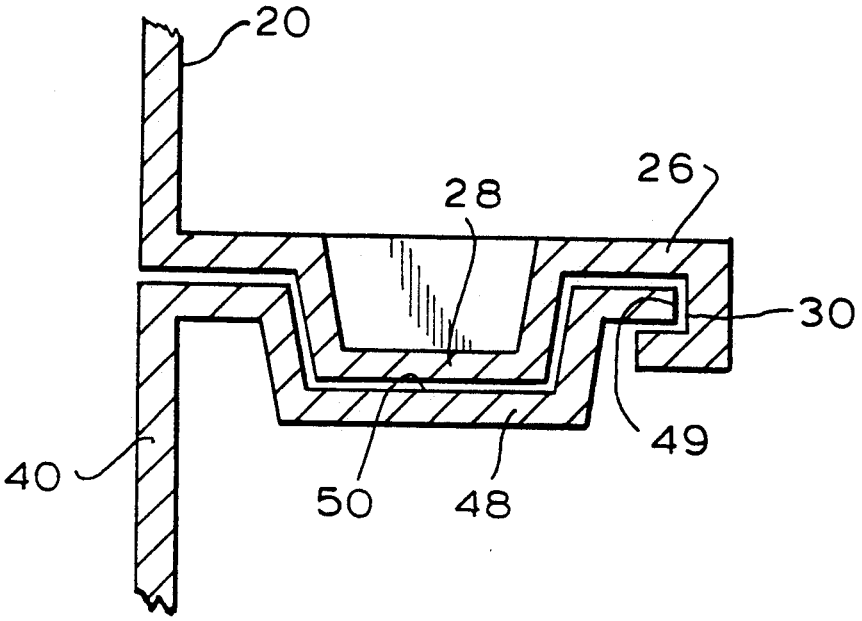
FIG. 3A is an enlarged fragmentary section of the locking and stabilizing means to close the top to the bottom.

Referring now to FIGS. 1 and 2, there is shown the handle 72 and the keyhole slot 74. Referring to FIG. 2, the handle 72 has an enlarged somewhat arrow shaped end 76. In use, the tip 76 is grasped and the handle 72 is drawn out along the partial cuts 76 back to the live hinge 78. The free end 76 is then lockingly inserted into keyhole 74 to provide a functional handle for carrying the carrier. A viable alternative is to form the handle 72 vertically in wall 40 of the bottom portion 14 and keyhole 74 in wall 20 of upper portion 12 or vice versa.

Have thus described my invention, it should be obvious to anyone skilled in the art that the posts 24 may be eliminated, reduced in size or enlarged and that alternatively the same may be said for the columns 52. Depending on the purposes of the user, these columns and posts when in alignment, form a chamber which may selectively not require both structures 24 and 52. It should be further evident that the structure could be molded or cast in two parts and the live hinge 54 omitted or replaced by locking devices similar to the channel 30 and edge 49 of lips 26, 48, respectively. Such an arrangement might prove preferable with aluminum or papier maché.

Figure 8:
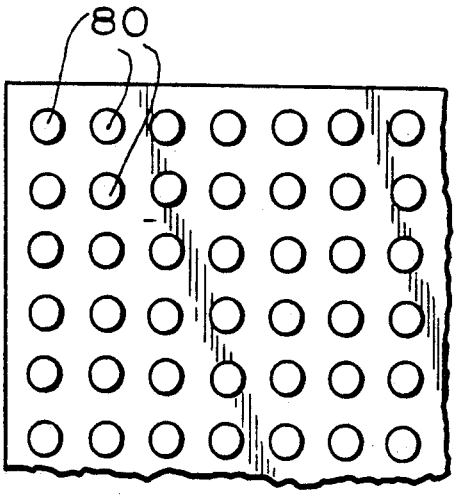
FIG. 8 is an enlarged fragmentary planar view of the stacking means of FIGS. 6 and 7.
Figure 6:
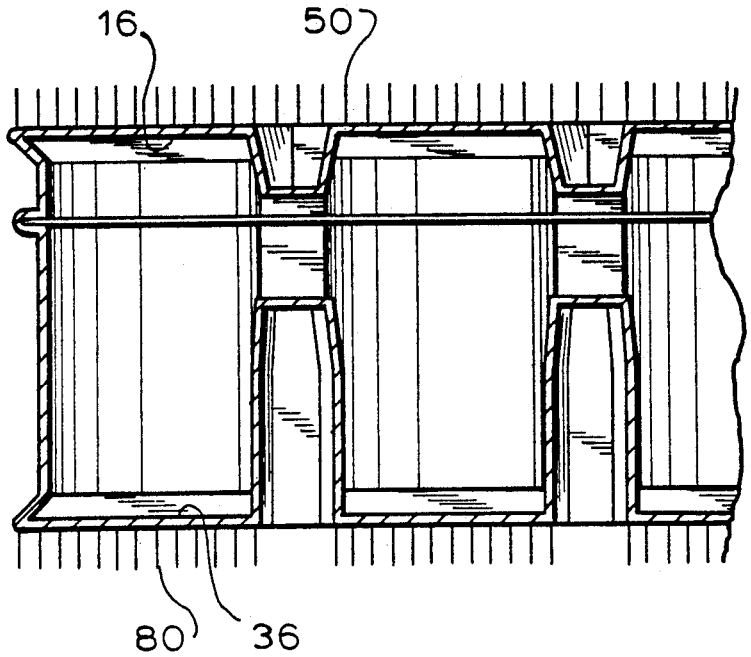
FIG. 6 shows modified stacking means.
Figure 7:
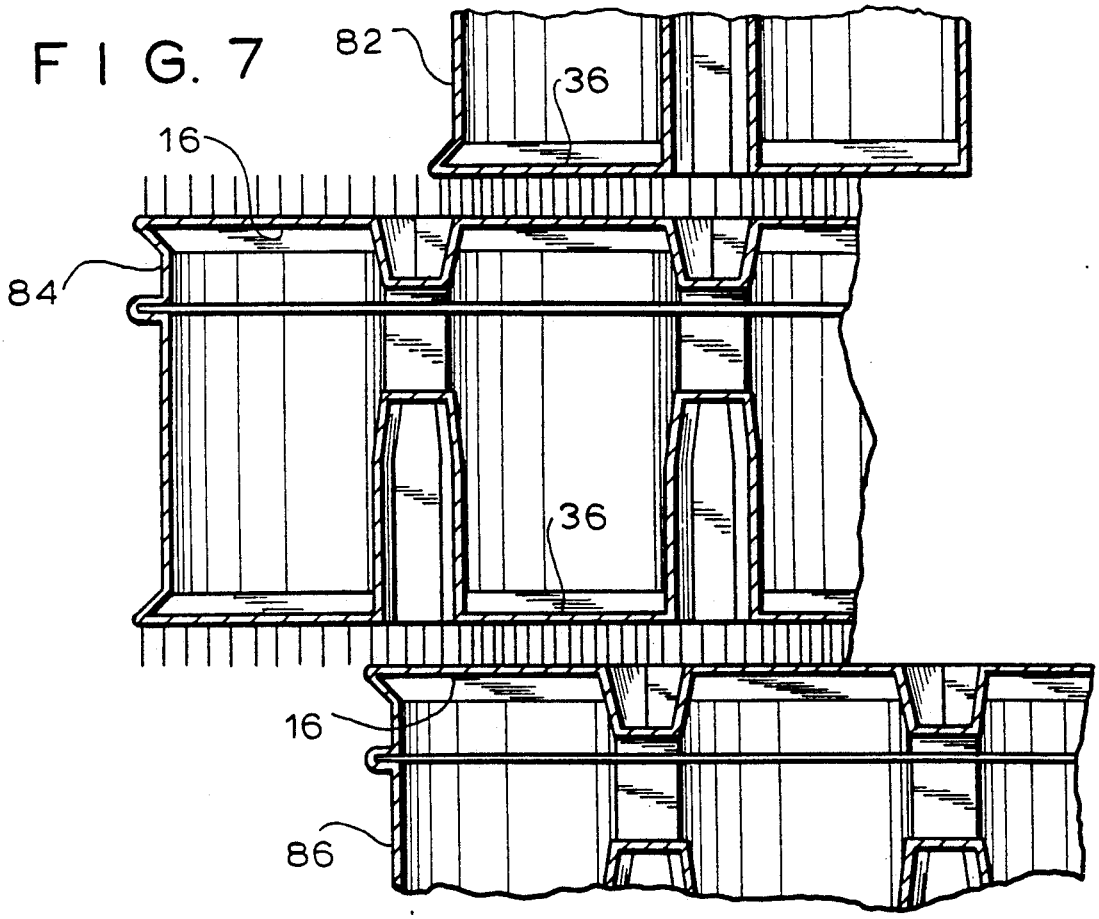
FIG. 7 shows fragments of carriers stacked by the means of FIG. 4.

FIGS. 6, 7 and 8 show an embodiment of my invention particularly useful for stacking. Civic groups such as the Boy Scouts, Fire Department and Girl Scouts collect recyclable containers and display their collection before shipment to a recycling plant. Desirably, these are stacked in selected configurations for display. This may be done by forming in the molding process the bristles 80 arranged in various patterns or clumps on the top and bottom of the carrier. Spikes or bristles 80 are indicated schematically in FIGS. 6 and 7 by single lines indicating the small diameter illustrated in the enlarged fragmental showing of FIG. 8. As illustrated in FIG. 7, bristles 80 on the bottom of a carrier 82 will interfinger with those on the top of another carrier 84 to stabilize the stack. In such an arrangement the structures 62, 66 (FIG. 1) and 64 and 67 (FIG. 5) would be unnecessary. While I have indicated the bristles 80 to be uniformly arranged throughout the top 16 and bottom 36 of carriers 82, 84, 86 it should be understood that no regular configuration is necessary nor is it necessary that the bristles cover the entire upper or bottom surfaces of the carrier. Bristles 80 from one carrier to the next will mesh much in the manner of two hairbrushes stuck together by intermeshing their bristles.

It is also contemplated that the structure be formed of biodegradable plastic (preferably recycled plastic) such as, for example, a plastic melded with hydrophobic modified starch or biodegradable composition such as described in Griffin U.S. Pat. No. 4,021,388. ECOSTAR and ECOSTAR Plus are proprietary additives of the St. Lawrence Starch Company of Mississuga, Ontario that may be added to polymers such as polyethylene and other long chain polymers to produce biodegradable plastics and/or photodegradable products.

The entire structure could be made, for example, of aluminum and in the case of collecting aluminum containers, the whole, namely containers and carrier, could be recycled. In my preferred embodiment however biodegradable plastic is the material of choice. Although of course, the structure could be made of any moldable substance such as metal, plastic, or papier mâché.

I claim:

1. A disposable compartmental carrier of predetermined height for cylindrical beverage containers, said carrier comprising a top portion and a bottom portion;

said bottom portion having a horizontal bottom, vertical sides and ends integral with and extending from said horizontal bottom and having a height shorter than said predetermined height, spaced hollow posts integral with and protruding from said horizontal floor into said bottom portion a distance short of said predetermined height and within the confines of said sides and ends;

each said post of said bottom portion comprising two pair of integrally formed oppositely facing walls and a post top joining said oppositely facing walls, said posts of said bottom portion being regularly arranged in rows and columns and comprising first means for receiving the outer curved surfaces of the lower ends of cylindrical beverage containers, said first means comprising four of said posts of said bottom portion presenting four circumferentially spaced surfaces comprising means for restraining a beverage container received therebetween;

said sides and ends of said bottom portion being formed with concave surfaces opposing ones of said walls on said posts of said bottom portion and together with said ones of said walls comprising second means for receiving the outer curved surfaces of the lower ends of cylindrical beverage containers, said ones of said walls and said concave surfaces formed in said sides and ends presenting circumferentially spaced surfaces for restraining beverage containers received therebetween;

said top portion having a horizontal top, sides and ends integral with and extending from said horizontal top and having a height shorter than said predetermined height, spaced hollow posts integral with and protruding from said horizontal top into said top portion a distance short of said predetermined height and within the confines of said sides and ends;

each said post of said top portion comprising two pair of integrally formed oppositely facing walls and a post top joining said oppositely facing walls, said posts of said top portion being regularly arranged in rows and columns and comprising first means for receiving the outer curved surfaces of the upper ends of cylindrical beverage containers, said first means comprising four of said posts of said top portion presenting four circumferentially spaced surfaces for restraining a beverage container therebetween;

said sides and ends of said top portion being formed with surfaces opposing ones of said walls on said posts of said top portion and together with said ones of said walls comprising second means for receiving the outer curved surfaces of the upper ends of cylindrical beverage containers for restraining beverage containers received therebetween;

said top portion being invertable upon said bottom portion with the free edges of said sides and ends of said top and bottom portions abutting, the combined heights of said sides and ends of said top and bottom portions being at least substantially as great as said predetermined height whereby containers restrained in said carrier are fully enclosed and restrained therein.

2. A carrier as set forth in claim 1 wherein said top portion is hinged to said bottom portion along the edges of one of the sides of each of said top and bottom portions, said top portion being movable from an open position in side-by-side adjacency with said bottom portion to a closed position overlying said bottom portion with the axes of said hollow posts of said top and bottom portions aligned.

3. A container as set forth in claim 2 and further characterized by cooperating gripper means on said top and bottom portions to hold said top and bottom portions together in juxtaposed position.

4. A carrier as set forth in claim 2 further characterized in that said horizontal bottom of said bottom portion has downwardly projecting integral bristles on the downward side thereof opposite said bottom portion posts and said horizontal top of said top portion has upwardly projecting integral bristles on the upward side thereof opposite said top portion posts whereby said bristles intermesh with other carriers when a plurality of said carriers in the closed operative configuration are stacked.

5. A carrier as set forth in claim 2 further characterized in that the bottom portion and the top portion laterally of said hollow posts have formed thereon male protrusions and female invaginations constructed and arranged so that when said top portion is inverted on said bottom portion, the male protrusions engage the female invaginations.

6. A carrier as set forth in claim 2 further characterized in that said posts of said top portion have sloped abutment means for engaging the tops of empty beverage containers supported in said bottom portion between said hollow posts of said bottom portion.

7. A carrier is set forth in claim 2 further characterized in that at least one of said top, said bottom, and said side walls has formed in it a handle cut-out structure, said cut-out being removable throughout a major portion of its periphery to provide a free end and hinged end, said free end having a reduced neck, a key hole puncture formed in one of said top, said bottom and said side walls so said free end may be inserted therein to engage said neck to form a handle.

8. The carrier of claim 2 wherein the upper surface of said horizontal top of said top portion and the undersurface of said horizontal bottom of said bottom portion are provided with interfitting means for securing carriers to each other in vertical stacked relation.

9. The carrier of claim 8 wherein said interfitting securing means comprises male lugs and female lug receptor openings.

10. The carrier of claim 8 wherein said interfitting securing means are positioned for securing carriers in vertical stacked and staggered relation.

11. A carrier as set forth in claim 1 wherein said integrally formed oppositely facing walls of said hollow posts of said bottom portion are concave along vertical planes parallel with the axes of said hollow posts of said bottom portion.

12. A plurality of disposable compartmental carriers of predetermined height, each comprising a top portion and a bottom portion for cylindrical beverage containers;

said bottom portion having a horizontal bottom, vertical sides and ends integral with and extending from said horizontal bottom and having a height shorter than said predetermined height, spaced hollow posts integral with and protruding from said horizontal floor into said bottom portion a distance short of said predetermined height and within the confines of said sides and ends;

each said post of said bottom portion comprising two pair of integrally formed oppositely facing walls and a post top joining said oppositely facing walls, said posts of said bottom portion being regularly arranged in rows and columns and comprising first means for receiving the outer curved surfaces of the lower ends of cylindrical beverage containers, said first means comprising four of said posts of said bottom portion presenting four circumferentially spaced surfaces comprising means for restraining a beverage container received therebetween;

said sides and ends of said bottom portion being formed with concave surfaces opposing ones of said walls on said posts of said bottom portion and together with said ones of said walls comprising second means for receiving the outer curved surfaces of the lower ends of cylindrical beverage containers, said ones of said walls and said concave surfaces formed in said sides and ends presenting curcumferentially spaced surfaces for restraining beverage containers received therebetween;

said top portion having a horizontal top, sides and ends integral with and extending from said horizontal top and having a height shorter than said predetermined height, spaced hollow posts integral with and protruding from said horizontal top into said top portion a distance short of said predetermined height and within the confines of said sides and ends;

each said post of said top portion comprising two pair of integrally formed oppositely facing walls and a post top joining said oppositely facing walls, said posts of said top portion being regularly arranged in rows and columns and comprising first means for receiving the outer curved surfaces of the upper ends of cylindrical beverage containers, said first means comprising four of said posts of said top portion presenting four circumferentially spaced surfaces for restraining a beverage container therebetween;

said sides and ends of said top portion being formed with surfaces opposing ones of said walls on said posts of said top portion and together with said ones of said walls comprising means for receiving the outer curved surfaces of the upper ends of cylindrical beverage containers for restraining beverage containers received therebetween;

said top portion being invertable upon said bottom portion with the free edges of said sides and ends of said top and bottom portions abutting, the combined heights of said sides and ends of said top and bottom portions being at least substantially as great as said predetermined height whereby containers restrained in said carrier are fully enclosed and restrained therein;

said top portion being hinged to said bottom portion along the edges of one of the sides of each of said top and bottom portions, said top portion being movable from an open position in side-by-side adjacency with said bottom portion to a closed position overlying said bottom portion with the axes of said hollow posts of said top and bottom portions aligned;

the upper surface of said horizontal top of said top portion and the undersurface of said horizontal bottom of said bottom portion being provided with interfitting means for securing carriers to each other in vertical stacked relation;

and each said carrier being constructed to contain beverage containers within said walls and surfaces of said hollow posts and sides and ends of said top and bottom portions, with said top portion of each carrier in the closed position, said carriers being arranged in vertical and staggered relation forming a wall of a selected display configuration.

* * * * *